US008061643B2

(12) United States Patent
Gingras et al.

(10) Patent No.: US 8,061,643 B2
(45) Date of Patent: Nov. 22, 2011

(54) REFINER PLATE FIXTURES FOR QUICK REPLACEMENT, AND METHODS AND ASSEMBLIES THEREFOR

(75) Inventors: Luc Gingras, Lake Oswego, OR (US); George Reynolds, Vancouver, WA (US)

(73) Assignee: Andritz Inc., Glens Falls, NY (US)

( * ) Notice: Subject to any disclaimer, the term of this patent is extended or adjusted under 35 U.S.C. 154(b) by 90 days.

(21) Appl. No.: 12/269,285

(22) Filed: Nov. 12, 2008

(65) Prior Publication Data

US 2009/0145989 A1 Jun. 11, 2009

Related U.S. Application Data

(60) Provisional application No. 60/992,843, filed on Dec. 6, 2007, provisional application No. 61/030,388, filed on Feb. 21, 2008.

(51) Int. Cl.
*B02C 25/00* (2006.01)

(52) U.S. Cl. ..... 241/298; 241/261.2

(58) Field of Classification Search ..... 241/261.2, 241/261.3, 298
See application file for complete search history.

(56) References Cited

U.S. PATENT DOCUMENTS

| | | | | |
|---|---|---|---|---|
| 3,551,990 | A * | 1/1971 | Wehner | 267/281 |
| 4,081,147 | A * | 3/1978 | Seifert et al. | 241/261.3 |
| 5,449,122 | A * | 9/1995 | Berger et al. | 241/261.2 |
| 5,875,982 | A | 3/1999 | Underberg | |
| 5,979,809 | A * | 11/1999 | Bartels et al. | 241/261.3 |
| 6,200,223 | B1 * | 3/2001 | Martens | 464/99 |
| 6,932,290 | B2 * | 8/2005 | Virving | 241/298 |
| 6,957,785 | B2 * | 10/2005 | Virving | 241/166 |
| 2009/0016807 | A1 * | 1/2009 | Koch | 403/26 |
| 2009/0108112 | A1 * | 4/2009 | Wakamatsu et al. | 241/261.2 |

* cited by examiner

*Primary Examiner* — Faye Francis
(74) *Attorney, Agent, or Firm* — Nixon & Vanderhye P.C.

(57) ABSTRACT

A refiner plate carrier for use in refining lignocellulosic material including a mounting mechanism for mounting to a refiner plate segment and not a rotor or stator disk. The combined plate carrier and refiner plate segment may be then attached to a refiner disk. The refiner plate carrier need not provide structural support to the segment during lignocellulosic refining.

13 Claims, 5 Drawing Sheets

REFINER PLATE FIXTURES FOR QUICK REPLACEMENT, AND METHODS AND ASSEMBLIES THEREFOR

RELATED APPLICATIONS

This application claims the benefit of U.S. Provisional Patent Application Ser. Nos. 60/992,843, filed Dec. 6, 2007, and 61/030,388, filed Feb. 21, 2008, the entirety of these applications are each incorporated herein by reference.

BACKGROUND OF THE INVENTION

This invention generally relates to mechanical refiners for lignocellulosic materials, and more specifically to a method and system for changing refiner plate segments in such a refiner.

Refiner plate segments are a critical component of the refining equipment. They are also a wear part that requires changing on a regular basis, in order to maintain the refining performance over time. For example, a typical circle of refiner plates is composed of anywhere between three (3) and twenty-four (24) equally-sized segments, which together form a circle. At every refiner plate change, all segments are removed, the mounting surface (that is, the surface of the rotor or stator disk) are cleaned, and the new segments must be installed one-by-one, shimmed to keep equal spacing and torqued properly.

Refiners usually have two circles of plates running opposite each other, or in case of twin refiners, they have four circles of plates (including a double-sided rotor). The refiner may be made with one rotor facing one stator (a rotating disk facing a stationary disk), or two opposite counter-rotating rotors.

The time required to change refiner plates segment-by-segment varies with the refiner type, but typically ranges from three (3) to twelve (12) hours, and generally requires a large number of workers to handle all the parts. It can be a long and expensive process, during which the mills are losing production time.

Some refiners are equipped with refiner plate holders. Those plate holders may be thick disks (usually on-inch (1"—25 mm) thick or more) onto which the individual refiner plate segments can be pre-mounted while the refiner is still in operation. When a refiner plate change is needed, the plate holder with the worn plates is removed then replaced with the plate holder with the new refiner plate segments. This can be done much faster and may require only one (1) to two (2) hours stop time as well as fewer workers. With this technology, the refiner plate segments are typically mounted solidly onto the plate holder, and the plate holder itself may be attached to the disk (which may be either a rotor or a stator disk). Due to the potential for very high forces in the refining process, this may require a thick plate holder acting as the binder between the disk and the rotor plate segments.

A limitation of the existing refiner plate holders is that they may require a certain minimum thickness in order to be used safely. Refiner plate segments may also have a minimum thickness requirement, allowing bolts to fasten them to the disk or to the plate holder. Generally, this minimum thickness may be in the region of an inch to one and a half inches (1.0-1.5"—25 mm to 38 mm), depending on the fastening method. The plate holder may also need to be at least one inch (1"—25 mm) thick (but may be thicker in some circumstances) in order to take the required stresses to safely retain plates on the holders. Altogether, there may be a minimum thickness requirement for the assembly that is greater than two inches (2"—50 mm) thick for using traditional plate holders. Many refiners do not have enough clearance to allow for the use of such a thick assembly. It may be possible to offset this requirement by making modifications to the refiner itself. Those modifications can be very expensive, because a new rotor disk may be necessary. Those modifications may also be irreversible.

It will be appreciated that the use of refiner plate holders in refiners is well-known. But existing refiners using plate holders are either designed to use these existing, well-known plate holders or must be modified—oftentimes significantly—in order to allow for the use of traditional plate holders. Known plate configurations may relate to sound absorption, as described in U.S. Patent Application Publication No. 2002/0166912 A1 to Schneid. Any retrofitting can increase the space requirement between the refining disks.

BRIEF DESCRIPTION OF THE PREFERRED EMBODIMENTS

In accordance with certain embodiments of the present invention, there is a full circle of refiner plates mounted onto a backing plate carrier that may be fitted onto a refiner disk. In certain embodiments, the combined thickness of backing plate carrier and refiner segments is thinner than prior art techniques involving plate holders. In at least some embodiments, the present invention may not require any modification to the refiner or its disks in order to be used.

In certain embodiments, the present invention may allow virtually any refiner to use full-circle refiner plate segment assemblies and may thus enable a reduced plate changing time and effort, without the need for any modification to the refiner itself. In certain embodiments, this may also allow the refiner to continue using separate segmented plates and the new refiner plate segment assemblies interchangeably.

In a certain embodiment, there is a refiner assembly comprising: a rotor comprising a rotor mounting surface for mounting a refiner plate segment for refining lignocellulosic material; and a stator comprising a stator mounting surface for mounting a refiner plate segment for refining lignocellulosic material. At least one of the refiner plate segments may be adapted to mount to a refiner plate carrier and to either mounting surface, and the refiner plate carrier may be adapted to mount to solely to the refiner plate segment and not adapted to mount to either mounting surface.

In a certain embodiment, there is a refiner plate segment comprising: a top surface for refining lignocellulosic material; a bottom surface for being supported by either a rotor or stator refiner disk mounting surface. The refiner plate segment may be adapted to mount to a refiner plate carrier and to either refiner disk mounting surface, and the refiner plate carrier may be adapted to mount to solely to the refiner plate segment and not adapted to mount to either refiner disk mounting surface.

In a certain embodiment, there is a refiner plate carrier comprising a configuration for mounting to a refiner plate segment for refining lignocellulosic material. The refiner plate segment may be adapted to mount to a refiner plate carrier and to a refiner disk mounting surface of a rotor or stator. The refiner plate carrier is not adapted to mount to the refiner disk mounting surface of a rotor or stator.

In a certain embodiment, there is a method of mounting a refiner plate segment having a multiple mounting configuration comprising the steps of: attaching the refiner plate segment to a refiner plate carrier to form a combined segment-carrier using at least one of the mounting configurations; and attaching the combined segment-carrier to a refiner disk mounting surface of a refiner for lignocellulosic material using a different mounting configuration of the refiner plate segment than the mounting configuration used to attach the refiner plate segment to the refiner plate carrier.

In a certain embodiment, there is a refiner assembly comprising: a refiner plate carrier; a bolt comprising a threaded portion and a head portion; a refiner plate segment comprising a top surface for refining lignocellulosic material; a bottom surface adjacent the refiner plate carrier; and a cavity for receiving the bolt; and a fixing nut for attaching the refiner plate carrier to the refiner plate segment using the bolt to form a combined segment-carrier, the fixing nut having a thickness less than a thickness of the plate carrier. The bolt is adapted to connect the combined segment-carrier to a refiner disk, and the refiner plate carrier is not adapted to structurally support the refiner plate segment during a process of lignocellulosic refining.

In a certain embodiment, there is a refiner assembly comprising: a refiner plate carrier; and a refiner plate segment comprising a top surface for refining lignocellulosic material; a bottom surface adjacent the refiner plate carrier; and a cavity for receiving a sleeve adapted to connect the refiner plate carrier to the refiner plate segment. The sleeve (i) comprises a cylinder and a collar, the collar having a width greater than a width of the cylinder, (ii) is adapted to connect the refiner plate segment and the refiner plate carrier to form a combined segment-carrier, and (iii) is adapted to receive a bolt comprising a threaded portion and a head portion. The bolt is adapted to screw into a refiner disk, thereby connecting the combined segment-carrier to a refiner disk by forcing the head portion against the combined segment-carrier. The refiner plate carrier is not adapted to structurally support the refiner plate segment during a process of lignocellulosic refining.

In a certain embodiment, there is a refiner assembly comprising: a refiner plate carrier; and a refiner plate segment comprising a top surface for refining lignocellulosic material; a bottom surface adjacent the refiner plate carrier. The refiner plate segment and refiner plate carrier are adapted to connect to each other, and the refiner plate carrier is not adapted to structurally support the refiner plate segment during a process of lignocellulosic refining.

DETAILED DESCRIPTION OF THE PREFERRED EMBODIMENTS

Figure 1:
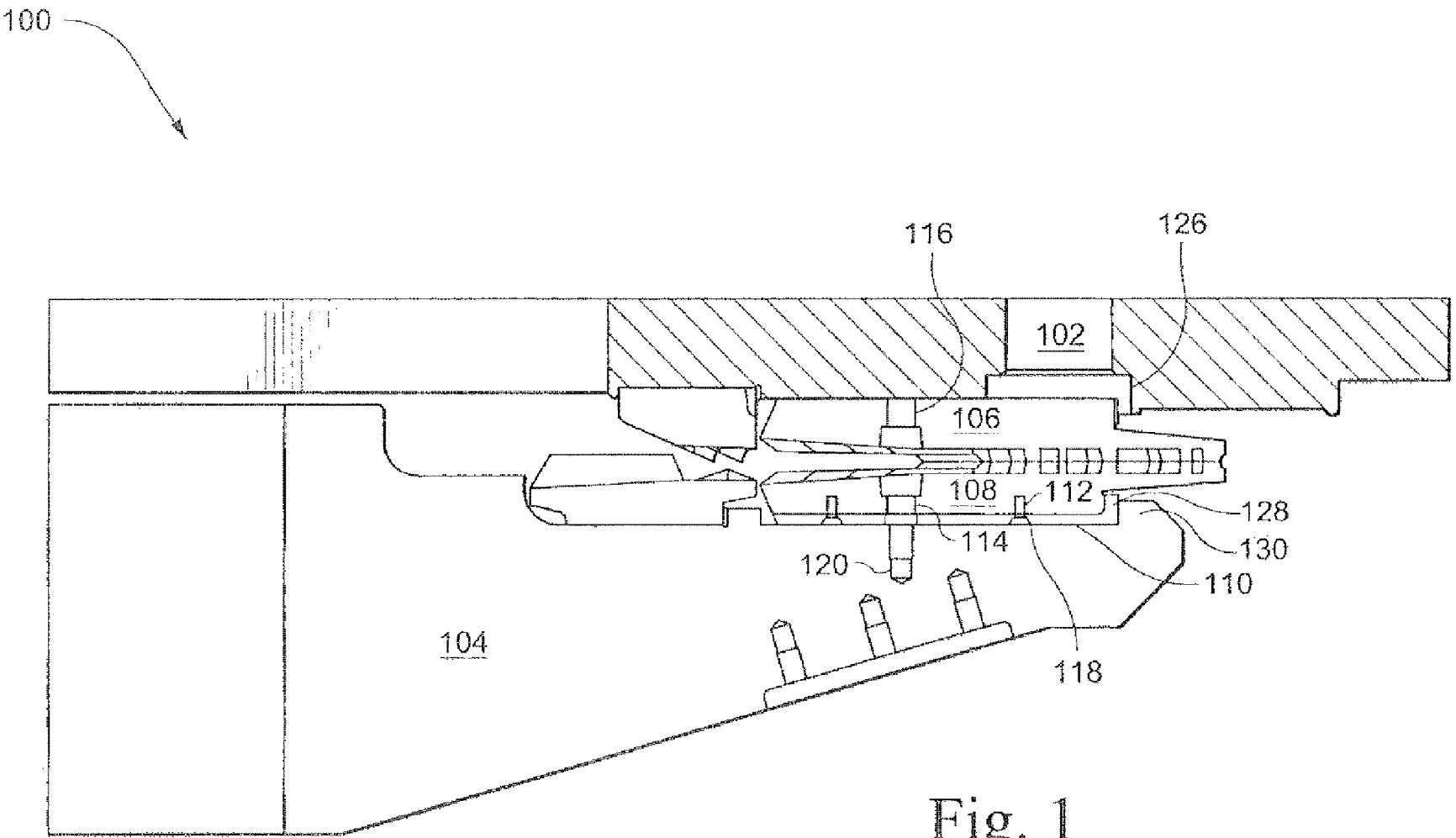
FIG. 1 is an exemplary illustration of cross-section of a refiner plate assembly including refiner plate segments and a plate carrier in accordance with an embodiment of the present invention.

At least some of preferred embodiments of the present invention relate to a refiner assembly including a plate carrier; a refiner plate—or plate segment—having at least two sets of mounting mechanisms (at least one for fastening the plate to the refiner disk, and at least one for fastening the plate to the plate carrier); a plate carrier with a mounting mechanism for fastening the refiner plate to the carrier but not the refiner disk; and various combinations and permutations thereof.

So as to maintain substantially the same thickness as the original refiner plates for the combination of refiner plate segments and plate carrier, certain embodiments of the invention may feature a thin plate carrier, e.g., approximately one-quarter inch (¼"—60 mm thick, which may act as a support system for the refiner plate segments until those segments are fitted into the refiner itself. The thickness added by the plate carrier can be removed from the segment thickness, so that the carrier and segment assembly has substantially the same thickness as the original segment, e.g., without the carrier and without a segment having a reduced thickness.

Once the plate carrier and segments are installed in the refiner, the assembly may be held in place in the manner that the original segments were being fastened. The segments themselves may be fastened onto the disk or mounting surface inside the refiner, leaving the plate carrier wedged between the disk and the refiner plate segments. By fastening the segments directly to the disk, the plate carrier need not be strong enough to support any of the forces that are acting on the refiner plate segments: the segments are attached to the disk and the carrier is held between segments and disk.

At least some preferred embodiments of the present invention relate to a refiner assembly including a refiner plate—or plate segment—having a mounting mechanism (such as a hole used in bolting the segment to the rotor); and a plate carrier with a mounting mechanism for fastening the refiner plate to the carrier but not the refiner disk through the use of a fixing nut, sleeve or the like. Preferably, the plate segments are fixed onto the plate carriers using the same openings as those used for fixing the segments to the disk, thus saving significant potentially costs on manufacturing of the plate segments. Rather than special segments with separate attachment mechanisms for the plate carrier and refiner disk, there may be more-or-less standard segments using one set of fixing holes in the carrier to attach the segments to both the carrier and the refiner. In other words, the plate carrier may not be itself attached to the refiner disk.

Preferably, the plate carrier is relatively thin and is not structural. That is, the plate carrier need only support the plate segments to facilitate installation in one or more pieces (rather than installation segment by segment) and need not be adapted to provide structural support to the refiner plate segments during the lignocellulosic refining operation. Preferably, the refiner plate segments are fixed temporarily to the carrier, so the segment-carrier assembly may be disassembled (e.g., after used in the refiner) and the carrier re-used.

In some preferred embodiments, there may be a single bolt connecting the plate segment to the refiner disk through the plate carrier. For example, there may be a nut fitting the bolt that may be tightened to secure the plate carrier to the refiner plate segment as well as a separate nut fitting the bolt that may be tightened to secure the combined plate carrier and refiner plate to the refiner disk. In these embodiments, the refiner plate, plate carrier, bolt, and nut are assembled prior to attachment to the refiner disk. That is, the bolt may be fixed to the plate-carrier assembly prior to attachment to the refiner plate. Some configurations may be particularly suited to refiner plates having a "T-Slot" for accepting a carriage bolt.

There may be, alternatively, a sleeve (such as a collared sleeve) that connects the plate segment to the plate carrier, e.g., via threads. The sleeve may be generally a hollow cylinder (like a pipe), such that a single bolt may be passed through the sleeve and connected to the refiner disk. For example, the sleeve may securely fasten the plate carrier to the plate segment without the presence of the bolt, such that the plate-carrier assembly need not include the bolt prior to attachment to the refiner disk.

Although preferred configurations may use a threaded connection between the sleeve and plate carrier, other attachment mechanisms. Further attachment mechanisms are also contemplated. Any attachment mechanism is preferably not permanent, such that the plate carrier may be reused. Preferably, the connection of the plate-carrier assembly with the sleeve need only be strong and durable enough to facilitate attachment to the refiner disk.

In certain embodiments, the plate carrier may be approximately one-quarter inch (¼") (or 60 millimeters) thick and may feature an outer diameter that corresponds to the plate mounting area of the refiner where the segments may be attached. The outer diameter of the plate carrier may sit against a outer diameter retaining lip of a mounting surface of a disk plate, so that the plate carrier may be centered properly in the refiner. The plate carrier may feature an optional lip at its outer diameter that can retain the segments into place and may provide a method for properly setting the segments into their position on the carrier.

In certain embodiments, the optional lip at the outer diameter may be one-quarter inch (¼"—60 mm) thick or more, such that it can allow proper position of the segments during pre-installation and provide enough strength when inserted into the refiner's own retaining lip. It may not only contribute to the structural integrity and strength of the plate carrier but it may also hold the segments in place despite the strong centrifugal forces acting on the rotor segments. Furthermore, the lip may ensure that the segments can be mounted onto the plate carrier correctly, for example, with appropriate spacing, proper balance, and proper positioning of segments with the disk for attaching the segments with bolts.

In certain embodiments, the plate carrier may include holes, such that the fastening bolts attached to the mounting surface of the disk may pass may through them to facilitate attachment to the refiner plate segments.

In certain embodiments, the plate carrier may also feature a basic attachment mechanism to temporarily attach the segments prior to final assembly in the refiner. Although the attachment may be strong enough to prevent segments from moving during transportation, it need not provide a strong enough bond to retain segments during refiner operation. In certain embodiments, there may be bolts holding segments onto the mounting surfaces of the refiner in a manner comparable to known methods and systems.

Due to the thin section of the plate carrier, countersunk bolt heads may be preferable as a method for fixing the segments onto the plate carrier. It may also be possible to use a traditional bolt—e.g., a bolt whose head may extend out of the plate carrier's surface—that mounts onto the refiner disk or mounting surface. In such a case, a recess may be machined into the refiner disk or mounting surface such that the bolt heads may be recessed, allowing the plate carrier to be substantially flat against the mounting surface. This may have the additional requirement of modification of the refiner disk or mounting surface, though it potentially provides a greater flexibility in positioning segments onto the plate carrier.

In certain embodiments, the refiner plate segments used in connection with this plate carrier may be similar to known (or traditional) ones. In other embodiments, the refiner plate segments may have a few differences. For example, the segments' thickness may be changed, such that the assembly (e.g., plate carrier and plate segment) may have substantially the same thickness of a traditional plate segment. Thus, in certain embodiments, the thickness of a plate segment may be reduced by approximately the same thickness of the plate carrier (e.g., about one-quarter inch (60 mm) thinner than a standard refiner plate segment). The outer diameter of the plate seat may also be shorter, such that the plate seat may fit in the plate carrier's outer diameter, which itself may fit into the refiner's plate seat outer diameter. In certain embodiments, for example, the diameter of a plate segment may be reduced by one-half inch (125 mm) or more in comparison with a standard refiner plate segment.

In some embodiments, refiner plate segments may feature overhangs—that is, parts of the refiner segment face that protrude beyond the seat diameter, thus allowing to use refiner plates with larger diameters than the refiner plate seat. In such an embodiment, the overhand portion may be slightly longer, and the design of the overhang may be modified to fit the plate carrier assembly.

In some embodiments, the plate carrier is substantially planar, such that it may complement the substantially planar surfaces of the refiner disk and plate segments. In other embodiments, the plate carrier is contoured, e.g., with one or more ribs or other protrusions creating a nonplanar surface. In such embodiments, the surface of the plate segment (and/or the refiner disk) may have complementary surfaces. These ribs may be circumferential with the focal point at the center of the refiner disk, though in other embodiments, they are not substantially circular.

The mounting method of the refiner plate segment to the refiner disk may remain as before, regardless of whether using bolts (e.g., counter-bored holes on the face of the refiner plate segments, with threads in the disk or a nut at the back of the disk), threaded inserts (e.g., where the threads are at the back of the refiner plates segment, and bolt may be inserted through the disk), or T-Slots (e.g., where the back of the refiner plate segment features a sliding slot that allows the use of carriage bolts, which may be fastened in the disk with a nut).

In certain embodiments, the refiner plate segment includes a fastening method onto the plate carrier. The refiner plate segment may feature at least one threaded hole on its back, although two or more may also be present. These threaded holes may allow the segments to be fastened to the plate carrier, such that the segments can be carried and/or fixed into the refiner substantially together as one unit. The threaded holes preferably match positions on the plate carrier where bolts can be inserted to fasten the refiner plate segments. This may allow the whole circle of refiner plates to be pre-assembled and inserted into the refiner as one piece, e.g., using an overhead crane or other mechanical lifting device.

In some embodiments, a lignocellulosic refiner may feature a simply supported design, in which the shaft runs through the refining section. In such a configuration, it may be possible to construct two half-circles of refiner plate carriers, using the same system described herein. Similarly, a refiner plate carrier may be made from any number of pieces, such as a three-piece or four-piece circle.

In yet further embodiments, there may be more than two refiner plate carriers per circle of plate segments. It is possible, for example, that the one or more refiner plate carrier(s) do not fit the entire circle of plate segments; that is, the refiner plate carrier may merely connect two or more segments without connecting all segments. In such an embodiment, it may be possible to construct an inlay in one or more plate segment (s) that fits the size and shape of the plate carrier, such that when constructed the plate carrier is substantially flush with the plate segment(s).

In preferred embodiments, the refiner plate segments are pre-installed on a relatively thin refiner plate carrier. It will be appreciated that small changes or modifications may be made in varying embodiments. For example, there may be a through hole in the face of the plate for mounting the segments onto the plate carrier (e.g., using a washer on the carrier).

FIG. 1 shows a cross-section of a refiner assembly 100 in accordance with an exemplary embodiment. Refiner assembly 100 contains a rotor 104 and a stator 102. These portions of the refiner assembly may be constructed in accordance with any of the known (and heretofore unknown) configurations of refiners for lignocellulosic materials. Stator 102, for example, has a refiner plate 106 attached in a conventional manner and configuration via hole 116. The refiner plate (whose precise configuration and refining surface is relatively unimportant) may rest against lip 126 during operation of the refiner. Refiner plate 106 may be bolted to stator 102 or attached in any other known manner.

Rotor 104 has a refiner plate 108 attached to it, e.g., via conventional methods and configurations, such as using holes 114 and 120. As illustrated, plate carrier 110 is also attached to refiner plate 108 through hole 112 that aligns with attachment point 118 in the plate carrier, and hole 114 in the refiner plate that aligns with attachment point 118 in the plate carrier. Plate carrier 110 is not itself attached to the rotor 104. Rather, the combined assembly of plate carrier 110 and refiner plate 108 that is attached to the rotor disk. Plate carrier 110 includes a lip 128, which is proximate to lip 130 and may abut against lip 130.

As shown in the exemplary embodiment of FIG. 1, the combined assembly of plate carrier 110 and plate 108 roughly corresponds to the size and shape of plate 106. In this respect, this embodiment may not require retrofitting or altering existing equipment.

Figure 2A:
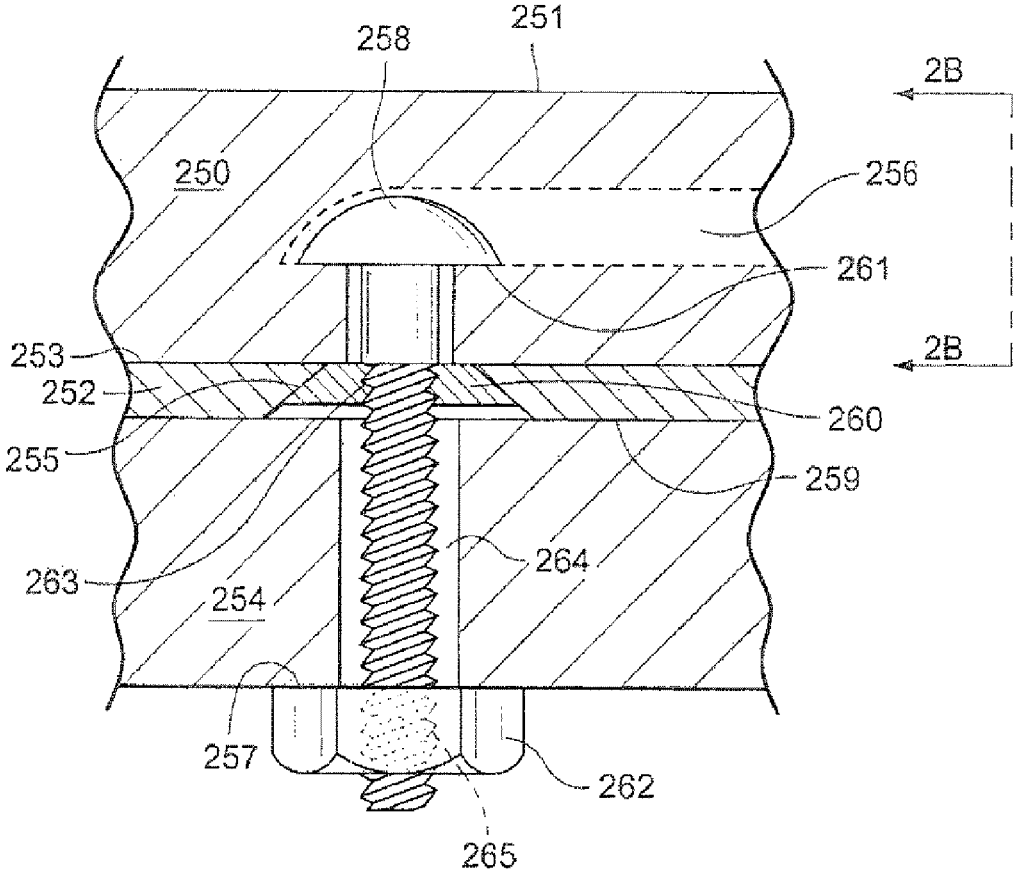
FIGS. 2A and 2B illustrate a partial assembly including a refiner plate segment and plate carrier in accordance with an embodiment of the present invention.
Figure 2B:
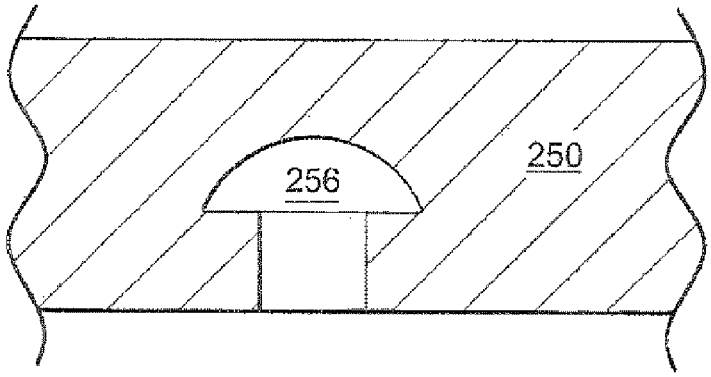

FIGS. 2A and 2B schematically and partially illustrate an assembly of a refiner plate segment including a T-Slot, a carrier, a fixing nut, and a single bolt in accordance with an embodiment of the present invention. FIG. 2B is a cross-sectional view of a portion of FIG. 2A (as indicated by 2B-2B in FIG. 2A), and like components are numbered identically. Refiner plate segment 250 has a top surface 251 for refining lignocellulosic material and a bottom surface that is adjacent to plate carrier 252 at interface 253. Plate carrier 252 is adjacent to refiner disk 254 at interface 259. The refiner disk may correspond to rotor 104 or the stator 102.

T-Slot 256 accepts fixing bolt 258 (which may be a carriage bolt), such that the head of the bolt 258 slides into the cavity of the T-slot 256 in refiner plate segment 250. Bolt 258 preferably does not break or extend to the refining surface of segment 250. Refiner plate carrier 252 may then be affixed to bolt 258 via nut 260 at interface 255. The bolt 258 preferably has threads at interface 263 to engage thread on a passage through nut 260. Although not illustrated to scale, nut 260 preferably has a cross-sectional thickness less than the thickness of the plate carrier 252. As nut 260 is tightened, the conical outer surface of nut 260 exerts force on the plate carrier 252 at interface 255. The bolt 258 concomitantly exerts force on the plate segment 250 at interface 261 to, cinch the plate carrier 252 and plate segment 250 together.

Alternatively, other attachment mechanisms are contemplated, such that the plate carrier 252 may be held against or affixed to the refiner segments 250 prior to attachment to the refiner disk 254.

As illustrated, nut 260 has a conical cross-section. Although a conical nut may permit a larger area of contact at interface 255 between the plate carrier 252 and nut 260 than a cylindrical nut (which would only laterally contact the plate carrier), any configuration of the connection among nut 260, carrier 252, and segment 250 is suitable, so long as the carrier and segment are held together with sufficient strength to facilitate transport to and connection with the refiner disk. That is, at least some portion of carrier 252 is preferably between nut 260 and segment 250 to cinch the carrier to the refiner plate segment.

As illustrated, the segment-carrier assembly may be affixed to the refiner disk 254 using nut 262. Bolt 258 extends through refiner disk 254, may either be a stator or rotor. As nut 262 is tightened on bolt 258, the nut contacts refiner disk 254 at interface 257, and pulls the segment-carrier assembly 250, 252 towards the refiner disk 254 at interface 259. In certain embodiments, for example, the entire segment-carrier assembly may be fixed to the disk using nuts in a conventional manner.

Figure 3:
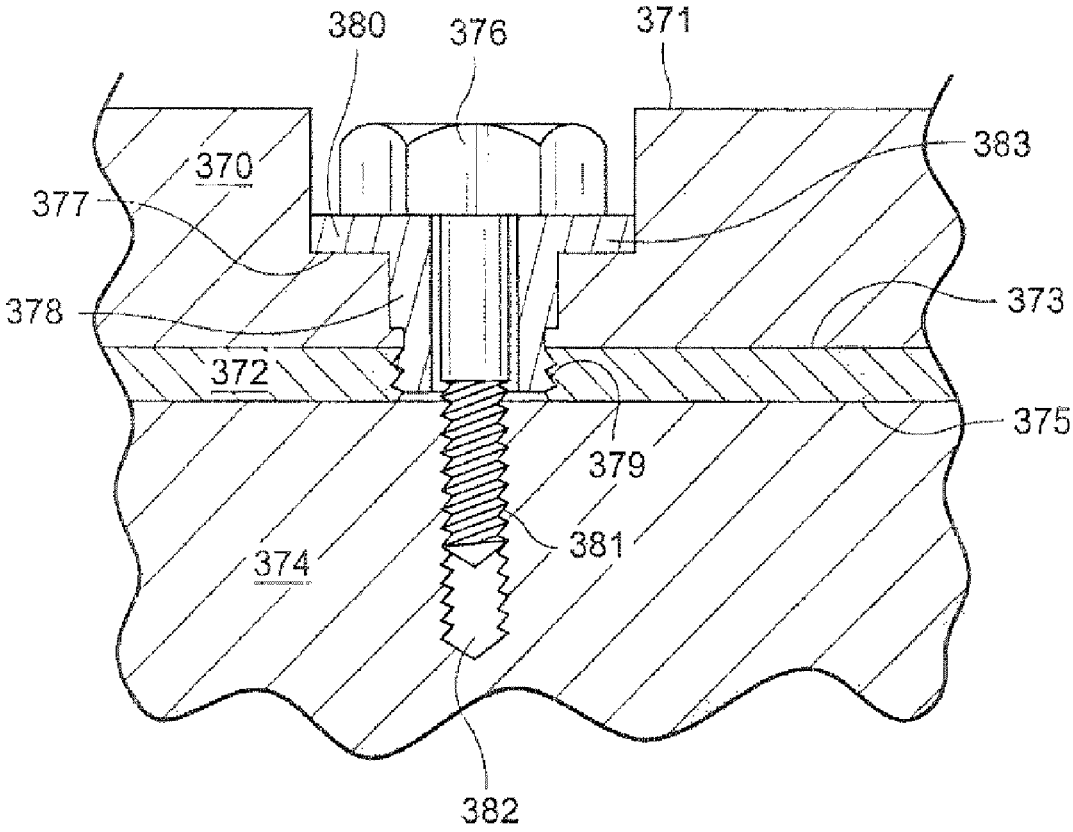
FIG. 3 illustrates a partial assembly including a refiner plate segment and plate carrier in accordance with an embodiment of the present invention.

FIG. 3 schematically and partially illustrates a cross-section of an assembly of a refiner plate segment including a carrier, a fixing sleeve, and a single bolt. Refiner plate segment 370 has a top surface 371 for refining lignocellulosic material and a bottom surface that is adjacent to plate carrier 372 at interface 373. Plate carrier 372 is adjacent to refiner disk 374 at interface 375.

Plate carrier 372 is affixed to refiner plate segment 370 by sleeve 378. As illustrated, sleeve 378 corresponds roughly to a cylinder (e.g., a pipe) having a collar 380 (e.g., a lip) that may be cinched against plate segment 370 at interface 377 to form an assembly of refiner plate segments on the plate carrier. The assembly facilitate transport of the refiner plates and there mounting to a disk of the rotor or stator. Sleeve 378 contains threads that screw into complementary threads on carrier 372 at interface 379. Of course, alternative connection mechanisms are contemplated in various embodiments.

As illustrated, the segment-carrier assembly may be affixed to the refiner disk 374 using bolt 376. Bolt 376 extends into refiner disk 374 which may either be a stator or rotor. Bolt 376 screws into a threaded cavity 382 of the refiner disk 374 via complementary threads at interface 381. As this occurs, bolt 376 forces the segment-carrier assembly 370, 372 towards and against the refiner disk 376 at interface 383. In certain embodiments, for example, the entire segment-carrier assembly may be fixed to the disk using nuts in a conventional manner.

Figure 4A:
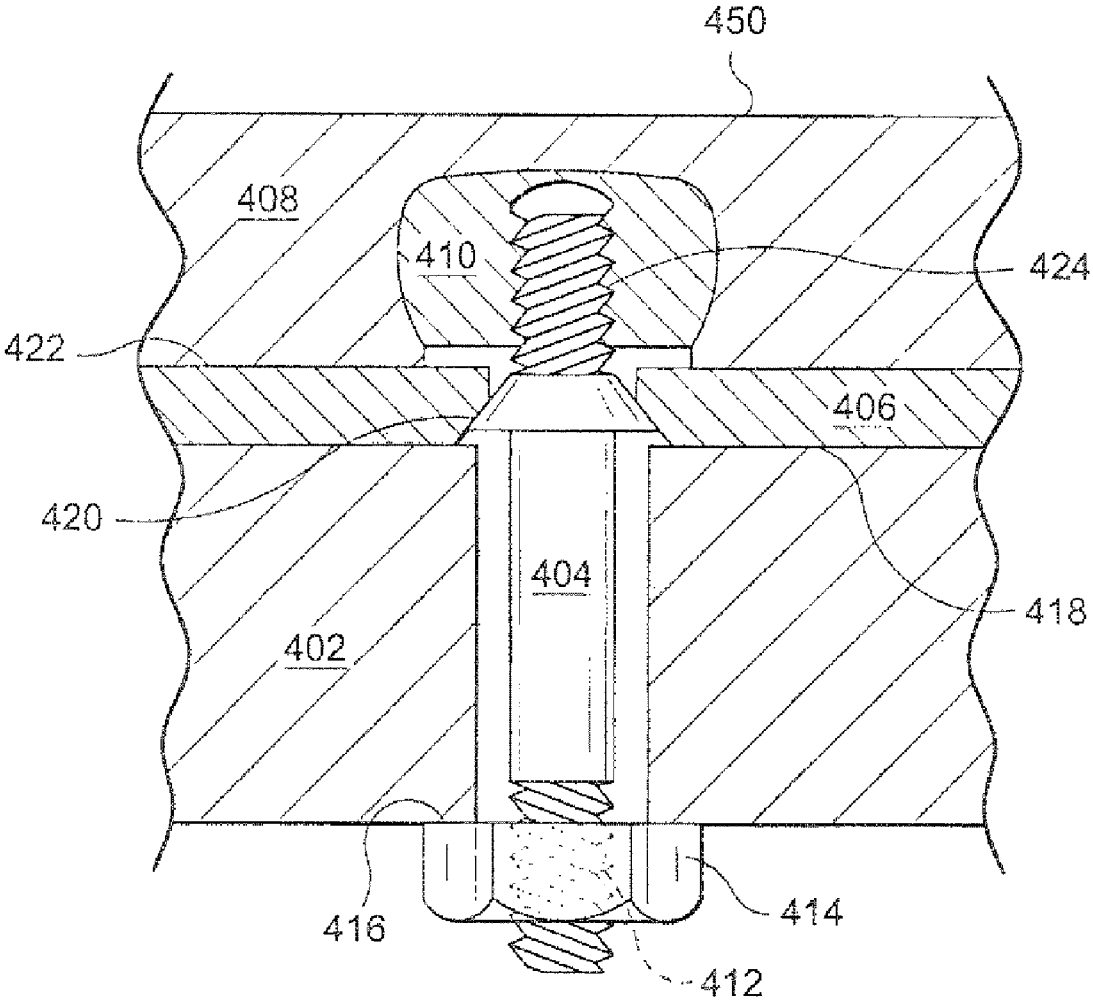
FIG. 4A illustrates a partial assembly including a refiner plate segment and a plate carrier in accordance with an embodiment of the present invention.
Figure 4B:
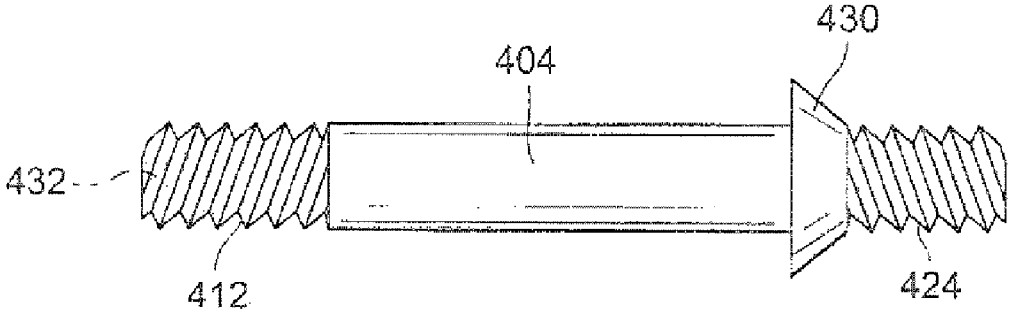
FIG. 4B illustrates a bolt suitable for use in accordance with the embodiment of FIG. 4A.

FIG. 4A schematically and partially illustrates an assembly of a refiner plate segment 408 including a cast-in insert 410, a carrier 406, and a bolt 404 having a fixing wedge adapted to secure plate segments to the plate carrier and separately adapted to secure the segment-carrier assembly to the refiner disk. FIG. 4B is a cross-sectional view of the bolt 404 illustrated in FIG. 4A, and like components are numbered identically. Refiner plate segment 408 has a top surface 450 for refining lignocellulosic material and a bottom surface that is adjacent to plate carrier 406 at interface 422. Plate carrier 406 is adjacent the refiner disk 402 at interface 418. The cast-in insert 410 preferably forms an integral part of refiner plate segment 408, such that bolt 404 does not extend beyond top surface 450.

In this embodiment, bolt 404 has threads 424 adapted to attach to a threaded passage in the cast-in insert 410. The bolt 404 both fastens the refiner plate segment 408 to the plate carrier 406 and fastens the segment-carrier assembly to the refiner disk 402. The bolt has threads 424, threads 412, and a flange portion 430 which may be conical or have another protruding. The end of bolt 404 to extend through the refiner disk may be adapted to receive a hex wrench (or other tightening tool) through a hollowed-out portion 432. As bolt 404 is screwed into cast-in insert 410 (e.g., using a hex wrench in the hollowed-out portion 432), the flange portion 430 cinches against carrier 406 at interface 420, to secure the entire assembly including carrier, segments, and bolt. The assembly may be transferred to a refiner disk and mounted as a single assembly to the disk. Of course, other attachment mechanisms are contemplated, such that the holding plate may be held against or affixed to the refiner segment prior to attachment to the refiner disk.

Refiner disk 402 is adapted to receive the assembly. The bolt 404 from the assembly may extend through refiner disk 402. A nut 414 may be attached to bolt 404 via threads 412. As the nut 414 is tightened, nut 414 cinches against refiner disk 402 at interface 416.

Figure 5:
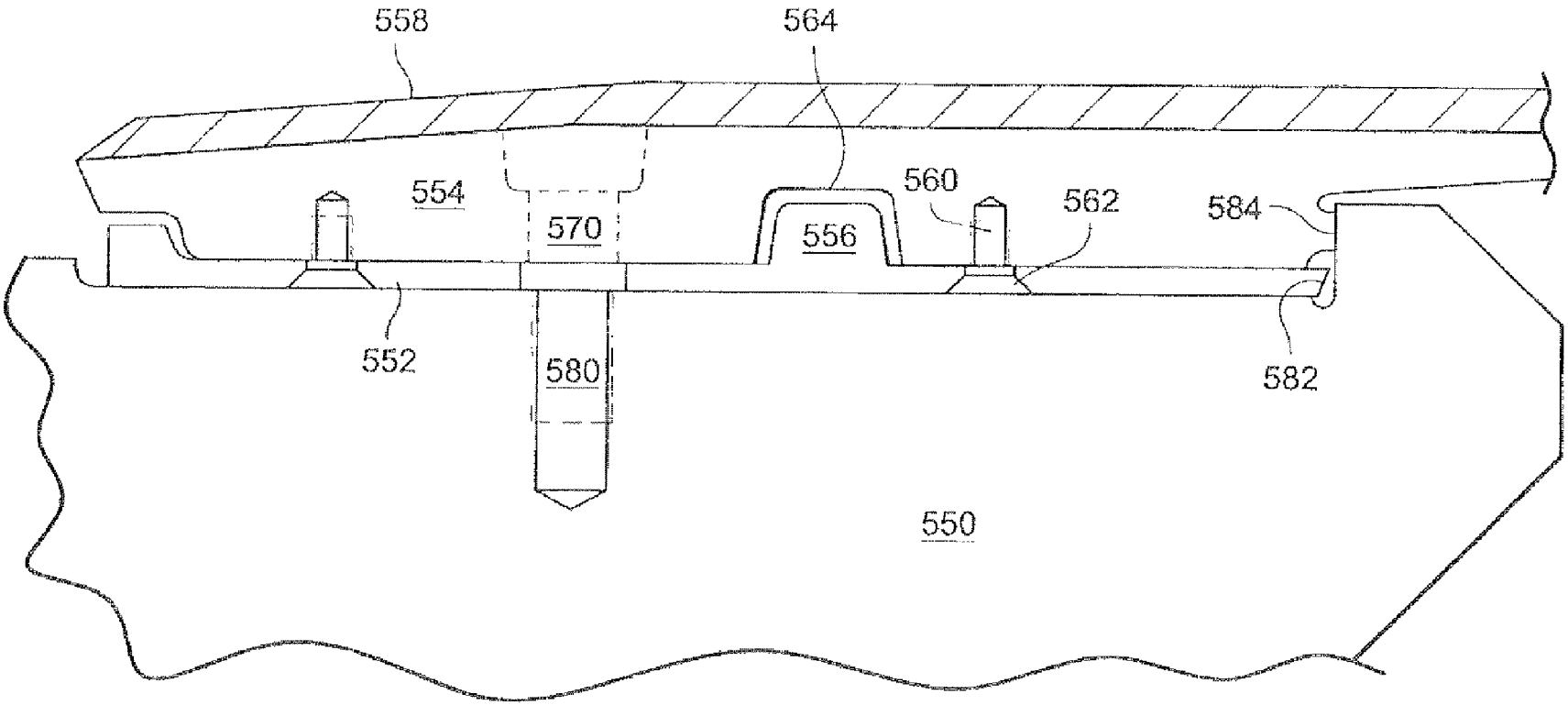
FIG. 5 illustrates a partial assembly including a refiner plate segment and a plate carrier in accordance with an embodiment of the present invention.

FIG. 5 schematically illustrates an assembly including a plate carrier 552 having a nonplanar surface and not having a lip along the outer circumference of the plate carrier in accordance with an embodiment of the present invention. As illustrated, the refiner segment 554 has top surface 558 for refining lignocellulosic material. Refiner segment 554 has cavity 570, which is adapted to receive a bolt (not illustrated) for attachment of the segment-carrier to refiner disk 550 via a threaded cavity 580 in the disk. The refiner segment 554 has a cavity 560 adapted to receive a bolt (not illustrated) for attachment of the plate carrier 552 through cavity 562. Plate carrier 552 may be generally planar and have a nonplanar surface, such as rib 556, which may extend partially or wholly circumferentially around the plate. Plate segment 554 has a complementary back surface to receive the nonplanar surface 556 of plate carrier 552, such that the rib 556 fits within the surface 564 of the plate segment. The seating of the rib 556 assists in aligning the plate segment 554 on the plate carrier 552.

Unlike the embodiment illustrated in FIG. 1, the plate carrier illustrated in FIG. 5 does not have a lip at outer edge 582. That is, the embodiment illustrated in FIG. 5 shows a plate segment 554 extending beyond the plate carrier 552 and contacting a lip on the refiner disk 550 at interface 584. It is not necessary that the plate segment contact the refiner disk.

It will be appreciated that all disclosed and claimed numbers and numerical ranges are approximate and include some degree of variation.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A refiner assembly comprising:

a rotor comprising a rotor disk having a mounting surface;

a refiner plate segment having a first surface for refining lignocellulosic material and an opposite surface facing the rotor disk;

a rotor carrier plate sandwiched between the rotor disk and the rotor plate segment; and a fastener including a shaft extending between the refiner plate segment and rotor disk and through the rotor carrier plate, wherein a first end of the shaft is fixed to the refiner plate segment and a second end of the shaft is fixed to the rotor disk, and an annular securing device is coaxial with and secured to the shaft, wherein the annular securing device abuts against the rotor carrier plate to clamp the rotor carrier plate to the refiner plate segment while the annular securing device is secured to the shaft, wherein the annular securing device has a surface abutting the rotor carrier plate and which faces towards the refiner plate segment.

2. The refiner assembly of claim 1, wherein the refiner plate carrier has an outer diameter, and wherein the refiner plate carrier has a raised lip at the outer diameter extending perpendicular to a plane defined by a surface of stator or rotor refiner disk contacting the refiner plate carrier.

3. The refiner assembly of claim 1, wherein the refiner plate carrier comprises a nonplanar surface facing the refiner plate segment, and wherein the refiner plate segment comprises a complementary surface adapted to receive the nonplanar surface of the refiner plate carrier.

4. The refiner plate assembly of claim 3, wherein the nonplanar surface comprises a circumferential rib.

5. A refiner assembly comprising:

a refiner plate carrier having an aperture extending through the refiner plate carrier;

a bolt comprising a threaded shaft and a head portion, wherein the shaft extends through the aperture in the refiner plate carrier;

a refiner plate segment comprising a top surface for refining lignocellulosic material, a bottom surface adjacent the refiner plate carrier; a cavity for receiving the head portion of the bolt and an aperture extending from the cavity and through the refiner plate segment, wherein the aperture has a diameter wider than the threaded shaft and narrower than the head portion of the bolt; and a fixing nut attaching to the threaded shaft and abutting against the refiner plate carrier to clamp the refiner plate carrier against the refiner plate segment wherein the fixing nut has a thickness less than a thickness of the refiner plate carrier and a diameter wider than the diameter of the aperture in the refining plate segment, wherein the fixing nut has a surface that abuts the refiner plate carrier and faces towards the refiner plate segment; and a refiner disk having a threaded aperture aligned with the aperture in the refiner plate carrier and receiving the threaded portion of the bolt, wherein a nut engages the threads of the threaded portion of the bolt and the bolt abuts against the refiner disk to secure together the refiner plate segment and the refiner disk.

6. The refiner plate assembly of claim 5, wherein the refiner plate carrier has an outer diameter, and wherein the refiner plate carrier has a raised lip at the outer diameter extending perpendicular to a plane defined by a surface of stator or rotor refiner disk contacting the refiner plate carrier.

7. The refiner plate assembly of claim 5, wherein the refiner plate carrier comprises a nonplanar surface facing the refiner plate segment, and wherein the refiner plate segment comprises a complementary surface adapted to receive the nonplanar surface of the refiner plate carrier.

8. The refiner plate assembly of claim 7, wherein the nonplanar surface comprises a circumferential rib.

9. A refiner assembly comprising:

a refiner plate carrier; and a refiner plate segment comprising a top surface for refining lignocellulosic material, a bottom surface adjacent the refiner plate carrier and a cavity receiving a sleeve connecting the refiner plate carrier to the refiner plate segment;

the sleeve comprises a cylinder and a collar fixed to the cylinder, the collar having a width greater than a width of the cylinder and the sleeve extends through an aperture in the refiner plate carrier and the collar abuts against the refiner plate carrier to secure the refiner plate carrier to the refiner plate segment;

wherein the refiner plate segment and the refiner plate carrier are connected by the sleeve to form a combined segment-carrier;

a bolt comprising a threaded shaft and a bolt head, wherein the bolt head engages a surface of the refiner plate segment and the threaded shaft extends through the cylinder of the sleeve;

wherein the threaded shaft extends into an aperture in a refiner disk and is fixed to the refiner disk.

10. The refiner plate assembly of claim 9, wherein the refiner plate carrier has an outer diameter, and wherein the refiner plate carrier has a raised lip at the outer diameter extending perpendicular to a plane defined by a surface of stator or rotor refiner disk contacting the refiner plate carrier.

11. The refiner plate assembly of claim 9, wherein the refiner plate carrier comprises a nonplanar surface facing the refiner plate segment, and wherein the refiner plate segment comprises a complementary surface adapted to receive the nonplanar surface of the refiner plate carrier.

12. The refiner plate assembly of claim 11, wherein the nonplanar surface comprises a circumferential rib.

13. A refiner assembly comprising:

a refiner disk a refiner plate carrier having a first surface abutting the refiner disk, and a refiner plate segment comprising a top surface for refining lignocellulosic material and a bottom surface abutting a second surface of the refiner plate carrier, wherein the second surface is opposite to the first surface such that the refiner plate carrier is sandwiched between the refiner disk and refiner plate segment; and a fastener including a shaft extending through the refiner plate carrier to fasten the refiner plate segment directly to the refiner plate, and the fastener includes an annular device attached to the shaft and, having a surface abutting the refiner plate carrier to clamp together the refiner plate carrier and the refiner plate segment, wherein the surface of the annular device faces towards the refiner plate segment.

* * * * *